US010816191B2

(12) United States Patent
Ni

(10) Patent No.: US 10,816,191 B2
(45) Date of Patent: Oct. 27, 2020

(54) STEAM HEATING APPARATUS AND METHOD FOR USE IN STEAM MOP

(71) Applicant: KINGCLEAN ELECTRIC CO., LTD., Suzhou, Jiangsu (CN)

(72) Inventor: Zugen Ni, Jiangsu (CN)

(73) Assignee: KINGCLEAN ELECTRIC CO., LTD., Suzhou, Jiangsu (CN)

( * ) Notice: Subject to any disclaimer, the term of this patent is extended or adjusted under 35 U.S.C. 154(b) by 231 days.

(21) Appl. No.: 15/579,368

(22) PCT Filed: Nov. 18, 2015

(86) PCT No.: PCT/CN2015/094859
§ 371 (c)(1),
(2) Date: Dec. 4, 2017

(87) PCT Pub. No.: WO2016/197545
PCT Pub. Date: Dec. 15, 2016

(65) Prior Publication Data

US 2018/0180277 A1 Jun. 28, 2018

(30) Foreign Application Priority Data

Jun. 8, 2015 (CN) ..... 2015 1 0308921

(51) Int. Cl.
*F22B 1/28* (2006.01)
*A47L 13/22* (2006.01)

(52) U.S. Cl.
CPC ..... *F22B 1/287* (2013.01); *A47L 13/22* (2013.01); *A47L 13/225* (2013.01); *F22B 1/28* (2013.01); *F22B 1/288* (2013.01)

(58) Field of Classification Search
None
See application file for complete search history.

(56) References Cited

U.S. PATENT DOCUMENTS 734,871 A * 7/1903 Hopwood et al. ..... F22B 3/04 122/40
1,475,589 A * 11/1923 Marden ..... F22B 27/14 122/32

(Continued)

FOREIGN PATENT DOCUMENTS

CN 1678868 A 10/2005
CN 2736650 Y 10/2005

(Continued)

OTHER PUBLICATIONS

International Search Report for corresponding Application No. PCT/CN2015/094859; dated Mar. 16, 2016.

(Continued)

*Primary Examiner* — Thor S Campbell
(74) *Attorney, Agent, or Firm* — Cantor Colburn LLP

(57) ABSTRACT

A steam heating apparatus, including a housing, a heater, a water inlet, and a steam outlet. The heater includes a base and a heating body vertically extending down from the base. The heating body includes a water inlet channel, a steam outlet channel, and heating pipes. The water inlet channel and the steam outlet channel are located between a pair of vertical heating pipes among the heating pipes. One end of the water inlet channel is communicated with the water inlet provided at one end of the heater, and the other end of the water inlet channel is opened to allow steam to flow out. The steam heating apparatus can fully utilize the heat of the heater, and the steam conversion efficiency and quality are higher. Meanwhile, the problem of blocking is prevented, and the performance of the heating apparatus is improved.

16 Claims, 5 Drawing Sheets

(56) References Cited

U.S. PATENT DOCUMENTS

| | | | | |
|---|---|---|---|---|
| 2,097,582 | A * | 11/1937 | Beyrodt | F22B 1/28 392/396 |
| 2,490,547 | A * | 12/1949 | Schraner | F22B 1/287 392/399 |
| 3,243,575 | A * | 3/1966 | Vignere, Sr. | F24H 1/0009 392/399 |
| 3,419,666 | A * | 12/1968 | Groom | F22B 1/287 373/109 |
| 4,408,116 | A * | 10/1983 | Turner | E21B 36/00 122/40 |
| 5,835,678 | A * | 11/1998 | Li | C23C 16/4486 392/401 |
| 6,748,904 | B1 | 6/2004 | Chiang | |
| 7,476,369 | B2 * | 1/2009 | Yin | A61L 2/07 392/399 |
| 7,577,343 | B2 * | 8/2009 | Chiang | F22B 1/284 122/40 |
| 8,554,063 | B2 * | 10/2013 | Hsu | F22B 1/28 122/40 |
| 9,404,649 | B2 * | 8/2016 | Ashton | F22B 1/285 |
| 9,618,196 | B2 * | 4/2017 | Sun | F22B 1/282 |
| 2006/0005437 | A1 | 1/2006 | Valiyambath Krishnan | |
| 2007/0187389 | A1 | 8/2007 | Chiang | |

FOREIGN PATENT DOCUMENTS

| | | | |
|---|---|---|---|
| CN | 20238131 | U | 7/2012 |
| CN | 202328130 | U | 7/2012 |
| CN | 202647694 | U | 1/2013 |
| CN | 203857446 | U | 10/2014 |
| CN | 104421988 | A | 3/2015 |
| CN | 104456501 | A | 3/2015 |
| CN | 104896454 | A | 9/2015 |
| CN | 204829836 | U | 12/2015 |
| JP | 2014214940 | A | 11/2014 |
| KR | 20120026795 | A | 3/2012 |
| WO | 2007089116 | A1 | 8/2007 |

OTHER PUBLICATIONS

Extended European Search Report corresponding to Application No. 15894801.8-1018/3306187 PCT/CN2015094859; dated Nov. 26, 2018.

* cited by examiner

STEAM HEATING APPARATUS AND METHOD FOR USE IN STEAM MOP

This is the U.S. National Stage of application No. PCT/CN2015/094859, filed on Nov. 18, 2015. Priority under 35 U.S.C. § 119 and 35 U.S.C. § 365 is claimed from Chinese Application No. 201510308921.9, filed Jun. 8, 2015, the disclosures of which are incorporated herein by reference.

FIELD

The present application relates to a heating apparatus and a heating method, and in particular to a steam heating apparatus and a steam heating method which are applied to a steam mop.

BACKGROUND

A steam mop has functions such as high-temperature sterilization and cleaning of greasy dirt. Water is heated to generate a pressure and a high temperature, and high-temperature and high-pressure steam is used directly for disinfection and sterilization to create a clean home environment. The steam generated under high pressure can not only perform cleaning but also perform sterilizing, which can easily deal with tough dirt. The steam mop can quickly clean dirt, for example, greasy dirt, aged and difficult to clear, in an extractor hood of a kitchen, mildew breeding in a damp bathroom, or the dirt in a car engine and a car interior, and so on, which is time-saving and labor-saving, economical and practical. There is no need to add any detergent, which is in full compliance with economic principles.

Since a principle of the steam mop is to perform disinfection and sterilization by the high-temperature and high-pressure steam, it is quite important for the steam mop to have a steam heating apparatus with an instantaneous heating function and a good heating effect. A conventional steam generator for the steam mop is typically a boiler-type steam generator or a coil-type steam generator. The boiler-type steam generator heats water in a water storage container continuously to generate steam from a liquid water surface, however, a disadvantage is that the water stored in the container has to be discharged in time after each use, otherwise the water stored in the container will deteriorate and thus will be unsanitary, and another disadvantage is that boiling of liquid water when the steam is generated may cause leakage of the steam generator. In the coil-type steam generator, coils are connected to a water source and a steam outlet respectively, and water stream from the water source is vaporized into steam in the coils after heat is exchanged between a heat exchanger and a heater.

Chinese Patent CN 201836857 discloses a steam generator for use in a steam mop. The steam generator includes a heat exchanger, an electric heater and a steam generating chamber formed by coils. Heat exchange is carried between coils and an electric heating tube by two layers of steam coils and an electric heating tube sandwiched there between to realize generation of the steam. However, in this manner, the coils are in a series connection in heat exchanging, which results in a large difference between temperatures of a front coil and a rear coil, and thus the entire steam heater has a low heating efficiency and a low heat utilization rate meanwhile dryness of the steam is reduced. Further, a water inlet and a water outlet are located outside the heating tube, resulting in poor effect of steam conversion, and the steam may still contain some drops of water, resulting in poor effect of steam output. Moreover, the coils have a small volume and thus entering of water mixed with impurities is apt to cause blockage. Therefore, the steam generator has poor performance.

Therefore, there is a demand for a heating apparatus which not only has an improved efficiency of water being converted into steam and utilizes the heat sufficiently, but also prevents blockage.

SUMMARY

In view of this, a heating apparatus for a steam mop is provided according to the present application. A water inlet and a steam outlet of the heating apparatus are arranged directly on a heater of the heating apparatus, and a water intake channel and a steam outlet channel are both arranged inside the heater of the heating apparatus, which not only improves efficiency of water being converted into steam but also utilizes heat of the heater sufficiently.

A steam heating apparatus proposed according to an object of the present application includes a housing, a heater, a water inlet and a steam outlet. The heater includes a base and a heating body extending vertically and downward from the base. The heating body includes a water intake channel, a steam outlet channel and a heating pipe. The water intake channel and the steam outlet channel are located between a pair of vertical heating sections of the heating pipe. The water intake channel has one end in communication with the water inlet arranged at an end of the heater, and another end open to allow steam to flow out. A nozzle in communication with the water inlet is arranged at the bottom of the water inlet. Water flows in from the water inlet and is scattered onto a tubular wall of the water intake channel by the nozzle. The steam outlet channel is in communication with the steam outlet provided at another end of the heater. The base covers the housing. The heating body is arranged in the housing which is provided with a housing opening allowing the steam outlet to extend to an outside. A heating chamber is formed between the heater and an inner wall of the housing. A steam intake hole is provided on the top of the steam outlet channel. The heated steam enters from the steam intake hole on the top of the steam outlet channel, and is ejected from the bottom of the steam outlet channel.

Preferably, the heating tube is a U-shaped heating tube. An electrode, which extends upward beyond the base, is arranged on each of two top ends of the U-shaped heating tube.

Preferably, the water intake channel is arranged on a side of the heating body, and the steam outlet channel is arranged on another side, opposite to the position of the water intake channel, of the heating body.

Preferably, the water intake channel and the steam outlet channel are located right in the middle of the pair of vertical heating sections of the heating pipe.

Preferably, the base of the heater is provided with a snap. A bayonet matching the snap is provided on an abutment surface of the housing, and the heater and the housing are hermetically connected by the snap and the bayonet.

Preferably, a housing sealing ring is arranged on the abutment surface of the housing abutting with the base of the heater.

Preferably, a diameter of the housing opening is equal to a diameter of the intersecting surface between the steam outlet and the housing opening, and a steam outlet sealing ring is provided at the intersecting surface.

Preferably, the heating body has an outer diameter less than an outer diameter of the base.

Further, it is provided according to the present application a steam heating method to which the steam heating apparatus described above is applied, and the steam heating method includes steps:

S1 in which, water enters from the water inlet and is injected into the water intake channel by the nozzle, and is heated into steam and flows out of the opening, at the end of the water intake channel, along the water intake channel;

S2, in which, the steam converted by the water intake channel fills up the heating chamber formed between the heater and the inner wall of the housing, and is heated again around the heater; and S3, in which, the steam enters the steam outlet channel via the steam intake hole and is heated once again, and the steam flows, along the steam outlet channel, out of the heating apparatus from the steam outlet.

Compared with the conventional technology, the present application has the following technical advantages.

The water inlet and the steam outlet are arranged directly on the heater, and the water intake channel and the steam outlet channel are both arranged in the heating body of the heater, which not only improves the efficiency of converting water into stream but also utilizes heat energy of the heater sufficiently.

Water is injected into the water intake channel by the nozzle connected to the water inlet. The design with the nozzle enables water stream to be dispersed, makes water injected to a larger space, and enables the water stream to be heated more sufficiently, and thus efficiency of water being converted into steam is improved.

The water inlet and the water intake channel are located at one side of the heating body, and the steam outlet and the steam outlet channel are located at another side of the heating body, thereby the steam is heated around various parts of the heater and the heat of the heater may be utilized sufficiently, therefore steam conversion efficiency is higher and the steam is of better quality.

Since the water intake channel is designed to be located in the heater and does not occupy external space, the water intake channel may be designed to have a larger channel volume, and thus an issue of channel blockage caused by impurities is avoided.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only examples of the present application, and for the person skilled in the art, other drawings may be obtained based on the drawings without any creative efforts.

Figure 1:
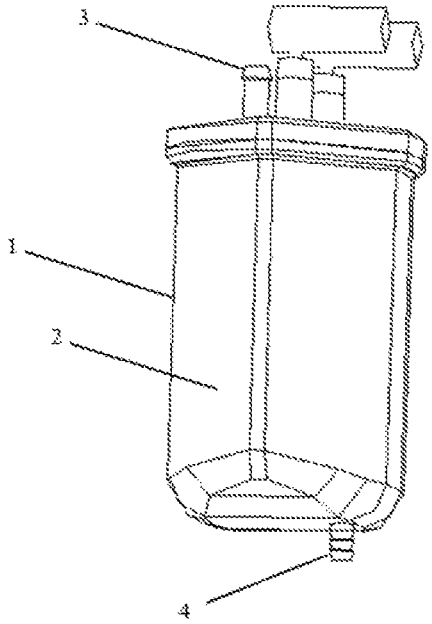
FIG. 1 is a front view showing an overall structure of a heating apparatus according to a preferred embodiment of the present application.
Figure 2A:
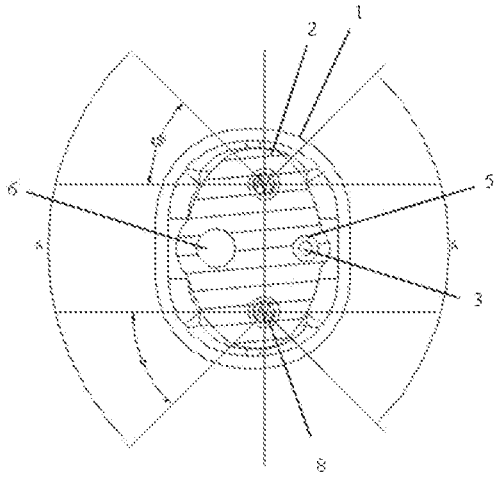
FIG. 2 is a schematic view showing an overall structure of a heating apparatus according to a preferred embodiment of the present application.

a FIG. 2A is a transverse sectional view of a heating apparatus according to a preferred embodiment of the present application.

Figure 2B:
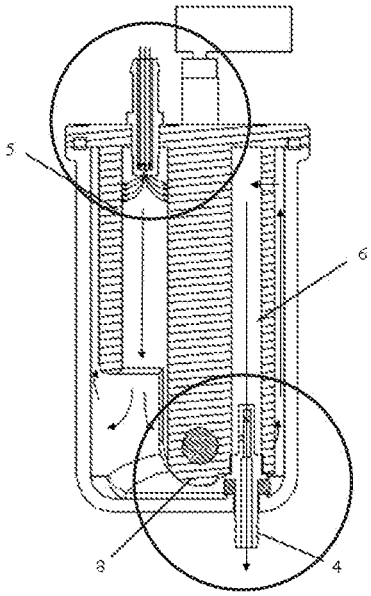

FIG. 2B shows a longitudinal section 1 of a heating apparatus according to a preferred embodiment of the present application, and shows flowing processes of water and airflow in a heater.

Figure 2C:
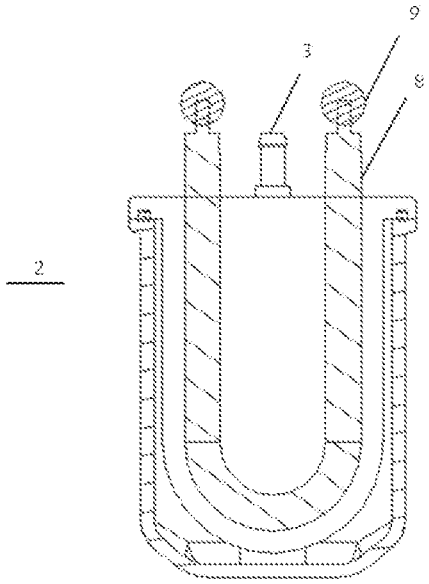

FIG. 2C is a longitudinal section 2 of a heating apparatus according to a preferred embodiment of the present application.

Figure 3A:
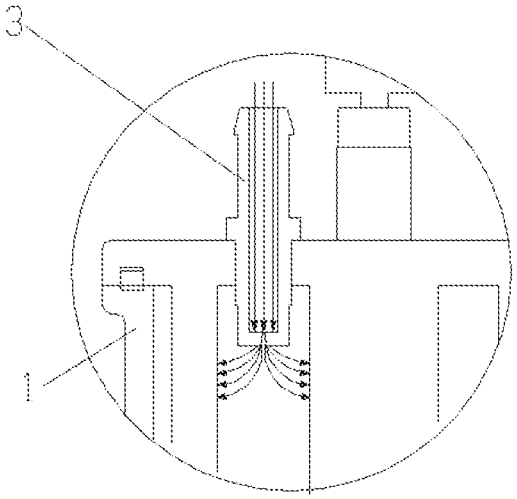
Figure 3B:
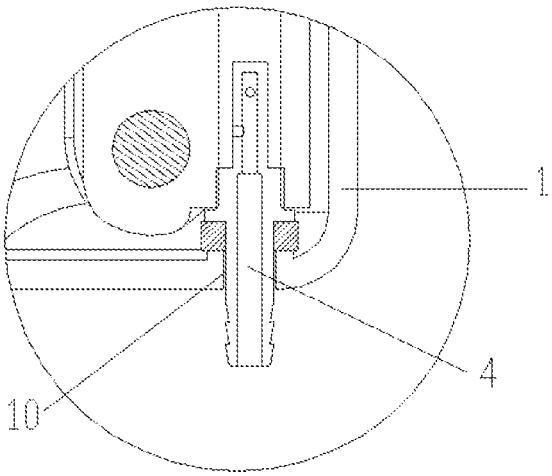

FIGS. 3A to 3B are partially enlarged schematic structural views of FIG. 2B.

Figure 4:
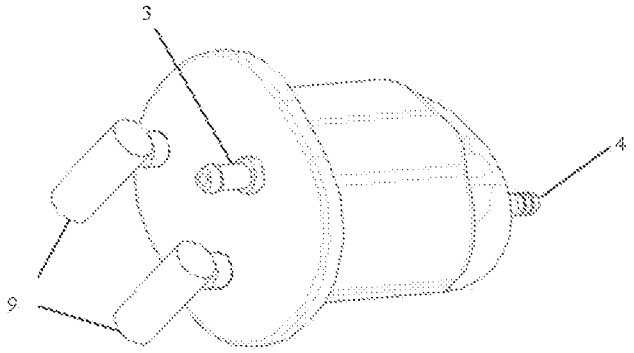

FIG. 4 is a schematic structural view of a heater according to a preferred embodiment of the present application.

Figure 5:
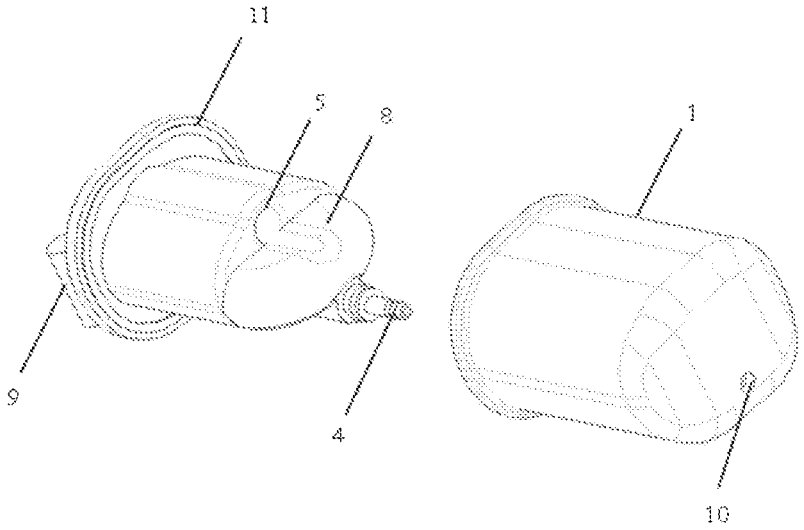

FIG. 5 is a schematic view of a structure of a heater separated from a housing according to a preferred embodiment of the present application.

Figure 6:
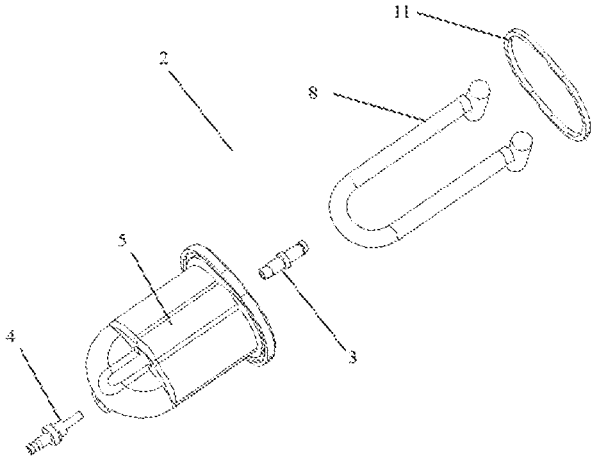

FIG. 6 is an exploded view showing parts on a side, where a water intake channel is provided, of a heater.

Figure 7:
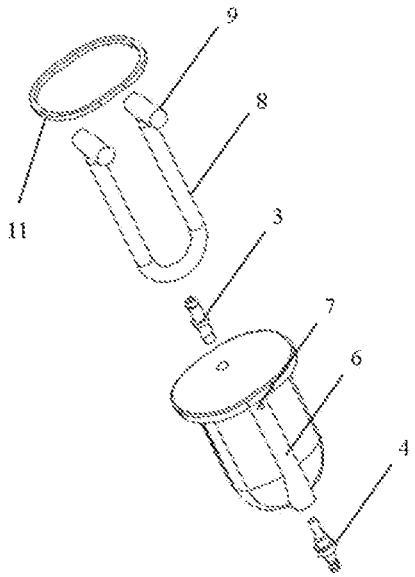

FIG. 7 is an exploded view showing parts on a side, where a steam outlet channel is provided, of a heater.

Explanation of reference numerals and components referred to in the drawings:

| | | |
|---|---|---|
| 1. housing, | 2. Heater, | 3. water inlet, |
| 4. steam outlet, | 5. water intake channel, | 6. steam outlet channel |
| 7. steam intake hole, | 8. heating pipe, | 9. electrode, |
| 10. housing opening, | 11. housing seal ring, | 12. steam outlet seal ring |

DETAILED DESCRIPTION OF EMBODIMENTS

As described in the background, a conventional heating apparatus for a steam mop has a low heating efficiency, a low conversion efficiency and a low utilization rate of heat, and has poor steam discharging effect and is apt to be blocked, and thus a steam generator has poor performance.

The specific technical solution of the present application is described in detail hereinafter.

Referring to FIGS. 1 to 7, a heating apparatus for a steam mop according to a preferred embodiment of the present application includes a housing 1, a heater 2, a water inlet 3 and a steam outlet 4. The heater 2 includes a base and a heating body extending vertically and downwards from the base. The heating body has an outer diameter less than an outer diameter of the base. The heating body is provided with a water intake channel 5, a steam outlet channel 6 and a heating pipe 8. The water inlet is provided on the top of the base and extends downward through the base into the water intake channel. The water intake channel extends vertically along the heating body and extends through the heating body. The water intake channel 5 has one end in communication with the water inlet 3 extending into the water intake channel and another end having a though-opening to allow steam to flow out. The steam outlet channel 6 is in communication with the steam outlet 4 arranged at an end of the heater. The housing 1 is provided with a housing opening 10 which allows the steam outlet to extend to the outside. The base of the heater 2 covers the housing. The heating body of the heater is accommodated in the housing 1, and a heating chamber is formed between the heater and an inner wall of the housing. The steam outlet channel 6 is provided with a steam intake hole 7 which is in communication with the steam outlet channel 6 and the heating chamber.

Specifically, the heating pipe 8 is a U-shaped part. An electrode 9, which extends upward beyond the base, is arranged on each of two top ends of the U-shaped heating tube. The electrode 9 has one end connected to one end of the heating pipe 8, and another end connected to a power supply (not shown in the figure) by an electrical wire (not shown in the figure). The water intake channel 5 is arranged on one side of the heater 2, and the water intake channel is located in a range "A" between a pair of vertical heating sections of the U-shaped heating tube 8. The water inlet 3 has a hollow tubular shape and is arranged at an upper end of the heater, and is integrally molded with or hermetically connected to the heater. Meanwhile, a nozzle, in communication with the water inlet 3, is arranged at the bottom of the water inlet 3. Water flows in via the water inlet and is scattered onto a tubular wall of the water intake channel 5 through the nozzle. By employing the nozzle, it is possible to disperse water stream, have water injected to a larger space and form a large contact area between water molecules and an inner wall of the water intake channel 5. Therefore, the water stream may be heated more sufficiently and thus the efficiency of water being converted into steam is improved. Meanwhile, since the water intake channel 5 is designed to be located in the heater, which does not occupy an external volume, the water intake channel 5 may be designed to have a larger channel volume, and thus water is injected to a larger space through the nozzle and an issue of channel blockage caused by impurities is avoided. An upper end of the water intake channel 5 is in communication with the water inlet 3 arranged on the upper end of the heater. An opening, which allows the steam flows from the water intake channel 5 into the heating chamber, is arranged at a lower end of the water intake channel 5. Since the water intake channel 5 is arranged directly in the heater, the water intake channel 5 has an extremely high temperature. When water is injected into the water intake channel 5, the water can be converted into steam quickly at a high temperature. Therefore, the conversion efficiency is high and energy consumption is low, and overall performance of the heater is improved. The converted steam flows out of the opening, at the lower end of the water intake channel 5, along the water intake channel 5, and the converted steam fills up the heating chamber formed between the heater 2 and the inner wall of the housing, and thus is heated again around the heater.

The housing 1 and the base of the heater 2 may be securely connected by a snap or a lock catch and so on in a hermetical manner. For example, the base of the heater 2 is provided with the snap, and a bayonet matching the snap is provided on an abutment surface, abutting with the base, of the housing 1. Alternatively, the base and the housing are provided with corresponding screw holes, and the base and the housing are connected by screws. Also, a sealing ring is arranged on an abutment surface of the housing 1 abutting with the base of the heater 2 for preventing water and the steam from overflowing, so as to further ensure sealing performance between the housing 1 and the heater 2.

The steam outlet channel 6 is arranged on another side, opposite to the position of the water intake channel, of the heating body, and the steam outlet channel 6 is located between the pair of vertical heating sections of the U-shaped heating pipe 8. The steam outlet channel 6 is in communication with the steam outlet 4 arranged at a lower end of the heater. A bottom end of the housing 1 is provided with a housing opening 10 which allows the steam outlet 4 to protrude out. A diameter of the housing opening 10 is equal to a diameter of an intersecting surface between the steam outlet 4 and the housing opening. In order to further ensure the sealing performance, a steam outlet sealing ring 12 is arranged on the side of the intersecting surface for preventing water and the steam from overflowing. The steam outlet channel 6 is provided with a steam intake hole 7 which is in communication with the steam outlet channel 6 and the heating chamber. After the steam converted by the water intake channel 5 is heated again around the heating chamber, the pressure in the steam outlet channel 6 is low, thus, the steam flows from the steam intake hole 7 into the steam outlet channel 6. In this case, since the steam outlet channel 6 is directly arranged in the heater, the steam outlet channel 6 has an extremely high temperature, and the steam is heated once again at a high temperature. The heated steam flows out of the heating apparatus along the steam outlet channel 6 and the steam outlet 4.

Reference is specifically made to FIG. 2A, which is a transverse sectional view of a heater according to a preferred embodiment of the present application. The water inlet 3, the water intake channel 5 is located on one side of the heating body, and the steam outlet 4 and the steam outlet channel 6 is located on another side of the heating body, which are just located between the pair of vertical heating sections of the U-shaped heating pipe 8. As can be seen from the figure, centers of the pair of vertical heating sections of the heating pipe lies in two vertical lines. Positions of the water intake channel 5 and the steam outlet channel 6 may be located within an angle formed between two lines which pass through the centers of vertical heating sections of the U-shaped heating pipe and are inclined to the horizontal line at an angle of 45 degrees, respectively, that is, located in the range "A". Preferably, the water intake channel 5 and the steam outlet channel 6 are located right in the middle of the pair of vertical heating sections of the U-shaped heating pipe. Therefore, the steam is heated around various parts of the heater and thus heat of the heater may be utilized sufficiently, such that steam conversion efficiency is higher and the steam is dryer and of better quality.

According to another embodiment, the water inlet 3, the water intake channel 5 and the steam outlet 4, the steam outlet channel 6 may alternatively be located on the same side of the heating body, and not located between the pair of vertical heating sections of the U-shaped heating pipe 8, as long as positions of corresponding openings are changed.

In the present application, the water inlet and the steam outlet are arranged directly on the heater, and the water intake channel and the steam outlet channel are both arranged in the heater, thus a smaller volume is occupied, and the water intake channel and the steam outlet channel may be made larger. Reference is made to FIG. 2B, in which flowing processes of water and airflow in the heater are indicated. Water is scattered into the water intake channel by the nozzle and heated sufficiently into steam. The steam flows in and fills up the heating chamber formed between the heater and the inner wall of the housing, and is heated again around the heater. Thereafter, the steam enters the steam outlet channel via the steam intake hole, and the steam is heated once again at a high temperature. The heated steam flows out of the heating apparatus along the steam outlet channel and the steam outlet. The heating apparatus according to the present application can utilize the heat of the heater sufficiently, has a higher steam conversion efficiency and generates steam of better quality, and moreover prevents blockage, and thus the heating apparatus has improved performance.

The description of the embodiments herein enables the person skilled in the art to implement or use the present application. Various modifications to the embodiments are apparent to the person skilled in the art, and the general principle defined herein can be implemented in other embodiments without departing from the spirit or scope of the present application. Therefore, the present application is not limited to the embodiments described herein, but should be in accordance with the broadest scope consistent with the principle and novel features disclosed herein.

The invention claimed is:

1. A steam heating apparatus, comprising:

a housing;

a heater;

a water inlet; and a steam outlet, wherein the heater comprises a base and a heating body extending vertically and downward from the base, the heating body of the heater is accommodated in the housing, and the base of the heater covers the housing and is hermetically connected to the housing, and a heating chamber is formed between the heater and an inner wall of the housing; and the heating body comprises a water intake channel, a steam outlet channel and a heating pipe, and the water intake channel and the steam outlet channel are located between a pair of vertical heating sections of the heating pipe, the water intake channel has one end in communication with the water inlet arranged at an end of the heater, and another end open to allow steam to flow out into the heating chamber formed between the heater and an inner wall of the housing, and a nozzle in communication with the water inlet is arranged at the bottom of the water inlet, and water flows in from the water inlet and is scattered onto a tubular wall of the water intake channel by the nozzle, and the steam outlet channel of the heating body is in communication with the steam outlet provided at another end, opposite to the end where the water inlet is arranged, of the heater, and the housing is provided with a housing opening allowing the steam outlet to extend to an outside, and a steam intake hole is provided on the top of the steam outlet channel, and the heated steam in the heating chamber formed between the heater and an inner wall of the housing enters from the steam intake hole on the top of the steam outlet channel into the steam outlet channel, and is ejected from the bottom of the steam outlet channel.

2. The steam heating apparatus according to claim 1, wherein the heating pipe is a U-shaped heating pipe, and an electrode, extending upward beyond the base, is arranged on each of two top ends of the U-shaped heating pipe.

3. The steam heating apparatus according to claim 1, wherein the water intake channel is arranged on a side of the heating body, and the steam outlet channel is arranged on another side, opposite to the position of the water intake channel, of the heating body.

4. The steam heating apparatus according to claim 1, wherein the water intake channel and the steam outlet channel are located right in the middle of the pair of vertical heating sections of the heating pipe.

5. The steam heating apparatus according to claim 1, wherein the base of the heater is provided with a snap, and a bayonet matching the snap is provided on an abutment surface of the housing, and the heater and the housing are hermetically connected by the snap and the bayonet.

6. The steam heating apparatus according to claim 5, wherein a housing sealing ring is arranged on the abutment surface of the housing abutting with the base of the heater.

7. The steam heating apparatus according to claim 1, wherein a diameter of the housing opening is equal to a diameter of an intersecting surface between the steam outlet and the housing opening, and a steam outlet sealing ring is arranged at the intersecting surface.

8. The steam heating apparatus according to claim 1, wherein the heating body has a maximum outer peripheral dimension smaller than a minimum outer peripheral dimension of the base.

9. A steam heating method, to which the steam heating apparatus according to claim 1 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

10. A steam heating method, to which the steam heating apparatus according to claim 2 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

11. A steam heating method, to which the steam heating apparatus according to claim 3 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

12. A steam heating method, to which the steam heating apparatus according to claim 4 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

13. A steam heating method, to which the steam heating apparatus according to claim 5 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

14. A steam heating method, to which the steam heating apparatus according to claim 6 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

15. A steam heating method, to which the steam heating apparatus according to claim 7 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

16. A steam heating method, to which the steam heating apparatus according to claim 8 is applied, comprising steps:

S1, wherein water enters from the water inlet and is injected into the water intake channel by the nozzle, and is heated into steam and flows, along the water intake channel, out of the opening at the end of the water intake channel;

S2, wherein the steam converted by the water intake channel fills up the heating chamber formed between the heater and the inner wall of the housing, and is heated again around the heater; and S3, wherein the steam enters the steam outlet channel via the steam intake hole and is heated once again, and the steam flows, along the steam outlet channel, out of the heating apparatus from the steam outlet.

* * * * *